United States Patent [19]

Gössler

[11] 4,394,646

[45] Jul. 19, 1983

[54] TEMPERATURE INDICATOR FOR A GLASS CERAMIC COOKING SURFACE

[76] Inventor: Gerhard Gössler, Mörikestr. 46, D-7519 Oberderdingen, Fed. Rep. of Germany

[21] Appl. No.: 201,563

[22] Filed: Oct. 28, 1980

[30] Foreign Application Priority Data

Oct. 31, 1979 [DE] Fed. Rep. of Germany ..... 2943922

[51] Int. Cl.[3] ..... H01H 37/46; H05B 3/02

[52] U.S. Cl. ..... 340/594; 200/61.58 R; 219/511; 307/117

[58] Field of Search ..... 73/339 R; 219/511, 464, 219/506, 453; 340/594, 597; 307/117

[56] References Cited

U.S. PATENT DOCUMENTS

| | | | |
|---|---|---|---|
| 2,735,924 | 2/1956 | Shaw | 219/453 X |
| 2,943,176 | 6/1960 | Holtkamp | 219/511 X |
| 2,993,976 | 7/1961 | Moore | 219/511 X |
| 3,243,792 | 3/1966 | Hamilton | 340/597 |
| 3,711,726 | 1/1973 | Wiechert | 307/117 |
| 3,719,796 | 3/1973 | Abildtrap | 219/464 X |
| 3,738,175 | 6/1973 | Linsig | 307/117 |
| 3,789,189 | 1/1974 | Fischer et al. | 219/464 |
| 4,201,735 | 5/1980 | Byam | 219/511 X |

FOREIGN PATENT DOCUMENTS

| | | | |
|---|---|---|---|
| 2627373 | 12/1977 | Fed. Rep. of Germany | 219/506 |

*Primary Examiner*—Daniel M. Yasich

*Attorney, Agent, or Firm*—Steele, Gould & Fried

[57] ABSTRACT

The temperature indicator has a temperature sensor which operates a switch. The temperature sensor is exposed to the heat of both the heating system of the glass ceramic cooking surface and an auxiliary heating system. The switch opens and closes a circuit including an indicating member indicating the state of the cooking surface. To ensure that the temperature indicator operates with maximum precision the switch is positioned outside the heated area and the temperature indicator is thermally closely coupled to the heating system of the glass ceramic cooking surface and/or the glass ceramic cooking surface itself. Thus, in all operating states its cooling time is the same as the cooling time of the glass ceramic cooking surface.

8 Claims, 1 Drawing Figure

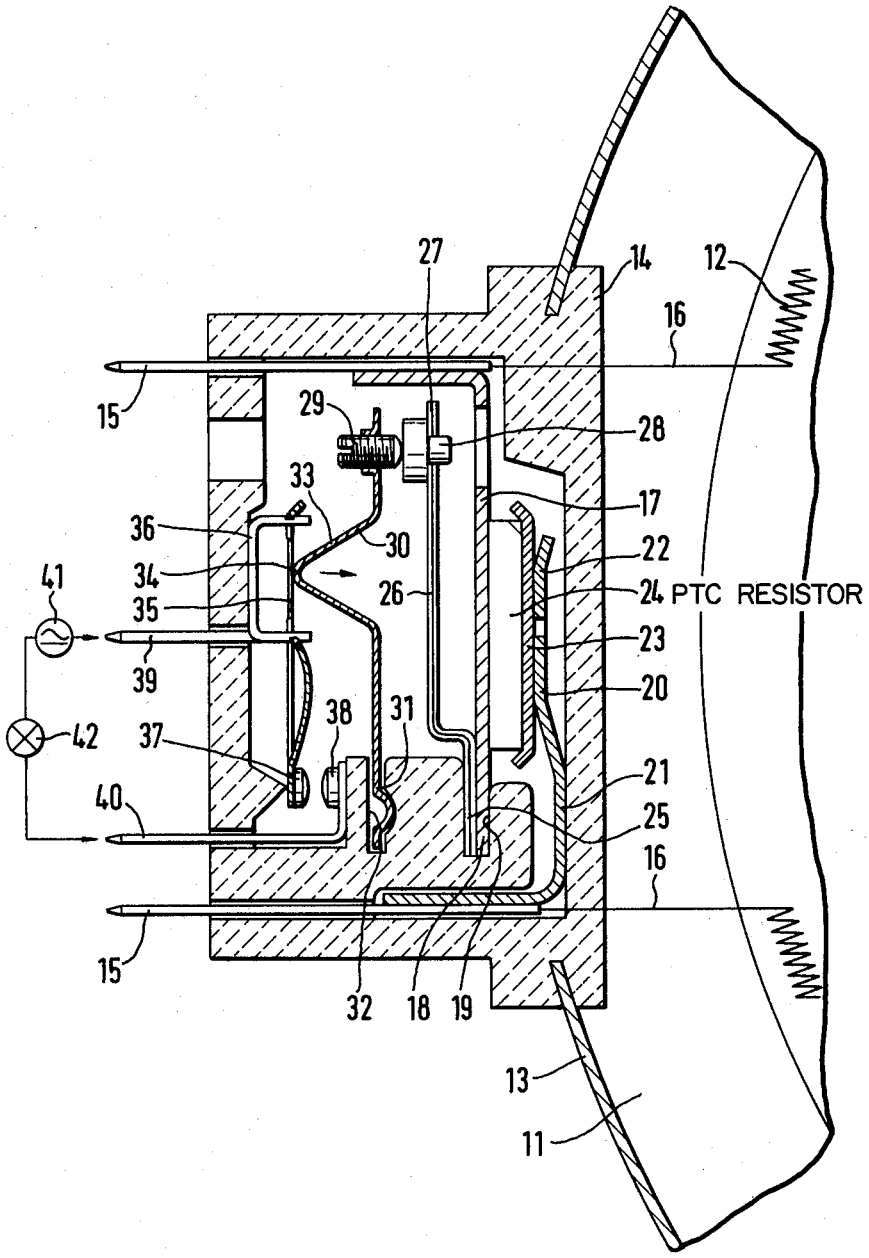
27
14
12
16
15
29
28
33
17
36
30
22
41
34
26
24 PTC RESISTOR
35
23
39
20
38
31
42
37
21
40
25
16
15
32
18
19
13
11

TEMPERATURE INDICATOR FOR A GLASS CERAMIC COOKING SURFACE

BACKGROUND OF THE INVENTION

The invention relates to a temperature indicator for indicating the temperature state of a glass ceramic cooking surface with an indicating device, in whose circuit is provided in a casing, a switching device having an auxiliary heating system optionally constructed as a PTC resistor, a temperature sensor and a switch operable by the latter.

Due to the smooth surface area of glass ceramic cooking surfaces, a problem arises when articles placed thereon by the user are thermo-sensitive. There is also a danger of burning or scalding on coming into contact with the glass ceramic surface. Consequently, there is a need for an indicating mechanism showing that the glass ceramic surface is warm or hot.

An indicating device is already known (DOS No. 2,627,373) in which a temperature sensor is in direct contact with the heating system of the glass ceramic cooking surface and operates a switch for operating an indicating member.

In addition, a residual heat indicating device with a lamp is known, whose circuit contains a switching device comprising a heating resistor and a temperature-dependent switching element (DOS No. 2,808,181). This device is thermally insulated in such a way that the cooling time up to the switching off of the lamp corresponds to the time in which the glass ceramic cooking area drops below a predetermined surface temperature. However, the disadvantages of this device is that the thermal insulation of the casing can only be constructed in such a way that the cooling time from a given temperature up to the time of switching off the lamp represents a constant value, which corresponds to the cooling time of the glass ceramic which is considered to be constant.

However, a problem arises with glass ceramic cooking surfaces in that the cooling period of the surface is not always constant from a given temperature and is instead dependent on which articles are placed on the cooking surfaces. Thus, e.g. if a large pot with boiling oil is located on the cooking surface, the cooling period for the latter is much longer than if no such pot was present. The known indicating device cannot take account of these differences. In addition, in the known device, the switch is exposed to very high temperatures, so a second switch is provided which switches off the auxiliary heating system in the case of elevated temperatures.

SUMMARY OF THE INVENTION

The object of the invention is to further develop a temperature indicator of the aforementioned type and to improve it in such a way that on the one hand it determines the cooking surface heating system temperature as accurately as possible and on the other is not damaged by the high permanent temperatures of the heating system. On heating, it must rapidly respond, but must also not provide incorrect results during the cooling of the glass surface.

This object is achieved in that the switch for the indicating device is located outside the heated area and in that the temperature sensor is thermally coupled so closely to the heating system of the glass ceramic cooking surface and/or to the glass ceramic cooking surface that its cooling time coincides with the cooling time of the glass ceramic cooking surface in all operating states.

These measures make it possible to ensure that the switch, which is located outside the heated area is not exposed to too high permanent temperatures and that the temperature indicator still provides a correct result if the cooking surface cooling time is lengthened by articles, possibly with a high thermal capacity standing thereon. The thermal coupling of the temperature sensor with the heating system or glass ceramic surface can be achieved by a corresponding construction of the casing, by the distance between the temperature sensor and the heating system or cooking surface, by the choice of heat transfer and by corresponding thermal insulation of the casing.

The temperature sensor can be an expansion element which preferably has a bimetal, while the auxiliary heating system can be connected parallel to the glass ceramic heating system. In per se known manner, the switch can be constructed as a snap-action switch to prevent radio interference.

To facilitate installation, according to the invention, the switch, temperature sensor and auxiliary heating system are positioned in a casing, which is open at one side and said components can be fixed therein by insertion. The casing is preferably arranged in the vicinity of the connection of the glass ceramic heating system, where it is fixed by introduction into a cutout on the edge of the glass ceramic supporting depression which supports the heating system.

According to another feature of the invention, the temperature indicator can be constructed in such a way that it forms the support for the glass ceramic heating system electrical power connections.

An individual temperature indicator can be provided for each hotplate of the glass ceramic cooking surface.

The auxiliary heating system can be a normal resistor, but it is particularly advantageous if it is constructed as a PTC (positive temperature co-efficient) resistor, the resistance of which increases with temperature. This type of resistor makes it possible to obtain a rapid indication from the indicating device on switching on the heating system, while in permanent or continuous operation only a small current flows through the PTC resistor.

The auxiliary heating system is preferably secured between two electrodes by spring action. The electrodes can either themselves have spring action or a spring can be provided which presses one electrode against the resistor and the other electrode.

The temperature sensor is also in heat-conducting connection with one electrode of the auxiliary heating system. This heat conduction can, for example, be obtained in that a portion of the temperature sensor engages directly on the electrode. This electrode can also serve to form a partition with respect to the switch zone.

In order to obtain an optimum utilization of the electrical properties of the PTC resistor, the invention also proposes that the Curie temperature of the PTC resistor is below the intrinsic temperature (normal operating temperature) in the case, adjacent the PTC resistor, during continuous operation of the heating system, while the maximum rated operating temperature of the PTC resistor is above this intrinsic temperature.

Thus, the invention proposes a temperature indicator, whose response characteristic is determined by the auxiliary heating system on switching on the glass ceramic surface heating system, while on switching off the heating system, the temperature indicator characteristic is determined by the heat given off by the glass ceramic surface.

BRIEF DESCRIPTION OF THE DRAWINGS

Further features, details and advantages of the invention can be gathered from the following description of a preferred embodiment, with reference to the drawing which shows a plan view of a temperature indicator according to the invention.

DETAILED DESCRIPTION OF THE PREFERRED EMBODIMENTS

The drawing diagrammatically shows the radiant body 11 of a glass ceramic cooking surface. Radiant body 11 houses the glass ceramic cooking surface heating system 12. An upwardly open casing 14 is introduced into a cutout of the edge 13 of the supporting depression for the radiant body 11. The connection 16 of heating system 12 terminating as pins 15 are passed through casing 14. To the upper pin 15 is fixed a first electrode 17, which is bent downwards at right angles and whose lower end 18 is located in a corresponding slot-like recess 19 of casing 14. To the other pin 15 is connected a spring 20, which is bent upwards approximately at right angles and whose central part 21 is supported on the casing. A second electrode 23 and a PTC resistor 24 are fixed between the upper end portion 22 of spring 20 and the free portion of electrode 17. By means of the spring action with which the upper end portion 22 of spring 20 is pressed against electrode 23, PTC resistor 24 and electrode 17 a good electrical transition between said parts is obtained. As the connection of those parts of the electrode 17 and/or spring 20 running parallel to the corresponding pins 15 is electrically conductive, this arrangement provides a parallel connection of PTC resistor 24 to the heating system 12 of the glass ceramic cooking surface.

The lower end 25 of a bimetallic lever temperature sensor 26 is connected to the lower end 18 of electrode 17. Bimetallic lever 26 is bent to the left in approximately Z-like manner, so that it can bend freely to the left or right in the drawing. In the vicinity of its upper end 27, bimetallic lever 26 is provided with an electrically insulating insert 28 against which presses the set screw 29 of a transmission lever 30. The lower end 31 of transmission lever 30 is inserted into and fixed with the aid of a slight bend in a corresponding slot 32 in casing 14.

In its central portion, transmission lever 30 has an approximately V-shaped deflection 33, whose apex 34 presses against the actuating member 35 of a snap-action switch 36. A pair of contacts 37 and 38 is arranged at the other end of switch 36 and are open in the position shown in the drawing. Contact 37 is connected via switch 36 with pin 39, while contact 38 is connected to pin 40. Pins 39 and 40 are switched into a circuit which, in addition to a power supply 41 contains an indicating member 42, e.g. a glow lamp.

Bimetallic lever 26 is arranged in such a way that it bends to the right in the drawing when subjected to rising temperature. The position of lever 26 illustrated in the drawing therefore shows the temperature indicator prior to activation of the heating system, that is, in the cold state.

The temperature indicator according to the invention operates in the following way. When voltage is applied to pins 15, both heating system 12 of the glass ceramic cooking surface and the PTC resistor 24 are heated. As the PTC resistor has a relatively low resistance value in the cold state, it heats rapidly, which directly leads to the bimetallic lever 26 bending to the right. As the transmission lever 30 is pretensioned in such a way that it also moves to the right and follows the movement of bimetallic lever 26, the actuating member 35 of snap-action switch 36 is unloaded, so that contacts 37 and 38 are closed. As a result, the circuit is closed, so that the voltage supplied by the power supply 41 leads to the operation of the indicating member 42. If indicating member 42 is a glow lamp, the circuit must also contain a series resistor. If with rising temperature, the resistance value of PTC resistor 24 increases, bimetallic lever 26 remains bent by the heat from heating system 12, so that even in permanent operation the circuit with power supply 41 and indicating member 42 remains closed. If the heating system 12 is switched off, which simultaneously interrupts the flow of current through PTC resistor 24, bimetallic lever 26 remains bent due to the heat from heating system 12 and consequently the snap-action switch remains closed.

A further important advantage of the present arrangement is that a considerable rise in the temperature leads to a mechanical unloading of the snap-action switch 36. The switching on point of switch 35 can be adjusted by set screw 29.

As is apparent from the drawing, casing 14 is arranged on the lateral edge immediately alongside the radiant body 11, so that the overall height of the glass ceramic cooking surface does not have to be increased due to the temperature indicator. As a result of this arrangement, the bimetallic lever 26 is thermally closely coupled not only to the heating system 12, but also to the actual glass ceramic surface. Casing 14 can be covered at the top to protect it against dirt and contamination.

The temperature indicator according to the invention can obviously also be used with contact heaters.

The auxiliary heating system for the bimetallically operated switch can be a normal resistor instead of a PTC resistor.

The temperature indicator can simultaneously serve as a connecting piece for the heating unit or it can be incorporated into said connecting piece.

I claim:

1. A temperature indicator for a glass ceramic cooking surface, the temperature indicator having an indicating device, a heat-sensitive switching device including an auxiliary heating system, a temperature sensor and a switch operable by the temperature sensor for activating the indicating device, the switching device, temperature sensor and switch being disposed in a casing that is thermally coupled to said cooking surface, the temperature indicator comprising:

two electrodes disposed in the casing, the auxiliary heating system being fixed therebetween by spring action, one of the electrodes forming a partition between the auxiliary heating system and the temperature sensor;

the auxiliary heating system including a positive temperature co-efficient (PTC) resistor having a Curie temperature below the ambient temperature of the casing during continuous operation of the heating system and having a maximum rated operating temperature above the continuous operating ambient temperature;

the switch for the indicating device being located away from the cooking surface for protection against thermal damage; and, the temperature sensor being thermally coupled so closely to the heating system of the glass ceramic cooking surface and to the glass ceramic cooking surface itself that the cooling time of the temperature sensor coincides with the cooling time of the glass ceramic cooking surface, notwithstanding variations in the cooling time of the glass ceramic cooking surface as normally occur.

2. A temperature indicator according to claim 1, wherein the casing is open at one side and is provided with for receiving and positioning slots, the switch, temperature sensor and auxiliary heating system being secured by insertion into the casing slots.

3. A temperature indicator according to claims 1 or 2, wherein the casing is disposed in the vicinity of the electrical power connection for the glass ceramic heating system.

4. A temperature indicator according to claim 1 wherein the temperature indicator forms a support for the electrical power connection of the glass ceramic heating system.

5. A temperature indicator according to claim 1, wherein the glass ceramic heating system rests in a supporting depression, the supporting depression having a cutout at its edge into which the casing can be inserted.

6. A temperature indicator according to claim 1, wherein the temperature sensor is in heat-conducting connection with one of the electrodes of the auxiliary heating system.

7. A temperature indicator according to claim 1, wherein said PTC resistor has an operational temperature above the intrinsic temperature of the casing during continuous operation of the cooking surface heating system.

8. A temperature indicator according to claim 1, wherein an electric circuit including the switch and the indicating device is electrically insulated from the circuit of the auxiliary heating system.

* * * * *

UNITED STATES PATENT AND TRADEMARK OFFICE

CERTIFICATE OF CORRECTION

PATENT NO. : 4,394,646

DATED : July 19, 1983

INVENTOR(S) : Gerhard Gossler

It is certified that error appears in the above-identified patent and that said Letters Patent are hereby corrected as shown below:

Column 1, line 33, "disadvantages" should be --disadvantage--.

Signed and Sealed this

*Eleventh* Day of *December 1984*

[SEAL]

*Attest:*

GERALD J. MOSSINGHOFF

*Attesting Officer*

*Commissioner of Patents and Trademarks*